US008894460B1

(12) United States Patent
Thompson

(10) Patent No.: US 8,894,460 B1
(45) Date of Patent: Nov. 25, 2014

(54) TOY SURFBOARD

(71) Applicant: Toyosity, LLC, Windermere, FL (US)

(72) Inventor: Joe Lee Thompson, Merritt Island, FL (US)

(73) Assignee: Toyosity, LLC, Windermere, FL (US)

( * ) Notice: Subject to any disclaimer, the term of this patent is extended or adjusted under 35 U.S.C. 154(b) by 35 days.

(21) Appl. No.: 13/788,355

(22) Filed: Mar. 7, 2013

Related U.S. Application Data

(63) Continuation of application No. 29/447,627, filed on Mar. 5, 2013, now Pat. No. Des. 711,485.

(60) Provisional application No. 61/647,910, filed on May 16, 2012.

(51) Int. Cl.
*A63H 23/00* (2006.01)
*A63H 23/10* (2006.01)

(52) U.S. Cl.
CPC ..... *A63H 23/10* (2013.01)
USPC ..... 446/153

(58) Field of Classification Search
USPC ..... 446/153, 155, 156, 160; 441/65, 74, 79; 273/441
See application file for complete search history.

(56) References Cited

U.S. PATENT DOCUMENTS

| | | | | |
|---|---|---|---|---|
| 954,544 | A | 4/1910 | Sanford | |
| 1,399,855 | A | 12/1921 | Fierlein | |
| 1,758,289 | A * | 5/1930 | Loy | 441/74 |
| D133,078 | S * | 7/1942 | Lee | D12/306 |
| D168,807 | S * | 2/1953 | Reuther | D21/547 |
| 83,120 | A | 10/1968 | Stoner | |
| 3,721,038 | A | 3/1973 | Viczena | |
| 3,871,127 | A | 3/1975 | Heath | |
| 4,768,988 | A | 9/1988 | Rutter | |
| 4,802,429 | A | 2/1989 | Butka | |
| 4,923,427 | A | 5/1990 | Roland | |
| D312,491 | S | 11/1990 | Roland | |
| 4,968,273 | A | 11/1990 | Momot | |
| 5,063,869 | A | 11/1991 | Bielefeldt | |
| 5,069,648 | A | 12/1991 | Ozeki | |
| D324,706 | S | 3/1992 | Gibson | |
| D424,569 | S | 5/2000 | Augusta | |
| 6,183,333 | B1 | 2/2001 | Hall | |
| 6,551,157 | B1 * | 4/2003 | Bishop | 441/65 |
| 6,692,321 | B2 | 2/2004 | Metrot | |
| 6,699,091 | B1 | 3/2004 | Warner | |
| 6,793,552 | B2 * | 9/2004 | Derrah | 446/154 |
| 7,401,786 | B2 * | 7/2008 | Lochtefeld | 273/441 |
| 2005/0109257 | A1 | 5/2005 | Lang | |

FOREIGN PATENT DOCUMENTS

| | | |
|---|---|---|
| WO | 9948581 | 9/1999 |

OTHER PUBLICATIONS

Thompson, J.L., Toy Surfboard, PCT/US2013/040510, PCT Search Report mailed on Aug. 12, 2013, 12 pages.

* cited by examiner

*Primary Examiner* — Kurt Fernstrom

(57) ABSTRACT

Toy surfboard toys and methods of a figurine mounted on a surfboard with hydrofoil allowing the surfboard to ride incoming waves back to a shore. The hydrofoil can have a V or boomerang shape with side wings having ends extending rearward and out from the surfboard. Wing ends can be curved discs for stability. Optional stabilizing tail/fin/rudder can extend rearward from the hydrofoil. Games can include racing toys by tossing them simultaneously from the shore to see which one reaches the shore first.

19 Claims, 15 Drawing Sheets

TOY SURFBOARD

CROSS REFERENCE TO RELATED APPLICATIONS

This invention claims the benefit of priority to U.S. Provisional Patent Application Ser. No. 61/647,910 filed May 16, 2012 and U.S. Design patent application Ser. No. 29/447,627 filed Mar. 5, 2013. The entire disclosure of each of the applications listed in this paragraph are incorporated herein by specific reference thereto.

FIELD OF INVENTION

This invention relates to toys, and in particular to a toy surfboard devices, apparatus and methods of playing a game with a figurine mounted on a surfboard and a hydrofoil rudder underneath the board for allowing the surfboard to ride incoming waves back to a shoreline.

BACKGROUND AND PRIOR ART

Popular marketed water toys over the years have generally included balls and blow up toys which may be fun to some but would have limited fun to surfers. Traditional toys such as dolls and the like, may also sink in the water or float out to sea, both of which would not be desirable. The inventor is not aware of any marketed surfboard toys that would be popular with surfers and beachgoers that is able to take advantage of the direction and power of incoming waves found along ocean and large lake shorelines.

A check of the U.S. Patent Office database has shown that some patents on toy type surfboards have been proposed in years past. See for example, U.S. Patents: Des. 312,491 to Roland; Des. 324,706 to Gibson, and U.S. Pat. No. 4,923,427 to Roland.

Although both Roland patents reference having heavy keels/fins, these toys are primarily for show. The downwardly protruding keels/fins would have difficulty in balancing the toy surfboard and keeping the surfboard in an upright position in the water.

Gibson '706 shows a surfer doll on top of a toy surfboard. The large mass of the doll compared to the thin toy board and single fin would not be able to balance in the water and would top be able to ride waves coming to shore at a beach. The top heavy doll would undoubtedly cause the toy capsize if used in the water without someone's hand holding the toy upright.

Furthermore, there is a good chance that Gibson '706 and possibly the Roland products would end up floating away and not being able to return to the shoreline which could result in the loss of these toys.

Thus, the need exists for solutions to the above problems with the prior art.

SUMMARY OF THE INVENTION

A primary objective of the present invention is to provide toy surfboard devices, apparatus and methods of playing a game with a figurine mounted on a surfboard and a hydrofoil rudder underneath the board for allowing the surfboard to ride incoming waves back to a shoreline.

A secondary objective of the present invention is to provide toy surfboard devices, apparatus and methods of playing a game, having a buoyant surfboard with a weighted hydrofoil which offsets the weight of a figurine mounted on the board which is able to continuously float on water in an upright position.

A third objective of the present invention is to provide toy surfboard devices, apparatus and methods of playing a game, having figurines that can interchangeably be mounted to the top of the surfboard.

A fourth objective of the present invention is to provide toy surfboard devices, apparatus and methods of playing a game with a figurine mounted on a surfboard and a hydrofoil rudder underneath the board, where players can simultaneously toss or throw respective surfboard toy devices, and determine a winner of the first surfboard toy to reach the shoreline.

A fifth objective of the present invention is to provide toy surfboard devices, apparatus and methods, which turns right-side up, points toward the shore after being put into a incoming shore wave, and returns to the shore each time it is used where the toy surfs the wave to the shore.

A sixth objective of the present invention is to provide toy surfboard devices, apparatus and methods, which takes advantage of the waves at a beach, instead of being overwhelmed, where a figurine on the toy stays upright and surfs the waves all the wave to the shore.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of the components referenced in the figures will now be described.

Figure 1:
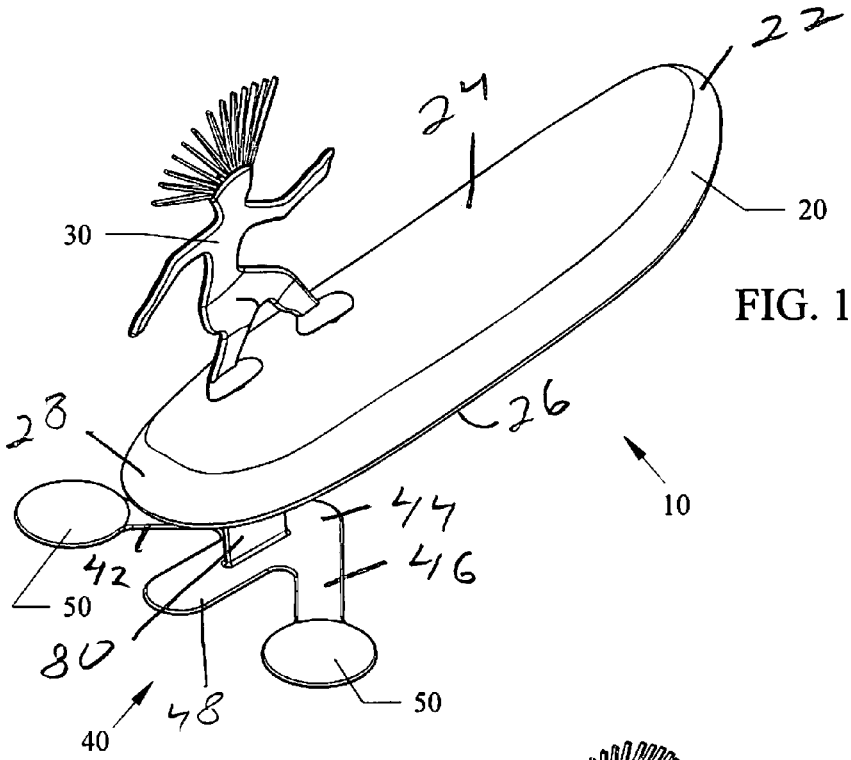
FIG. 1 is a top right perspective view of surfboard toy with mounted figurine and hydrofoil.
Figure 2:
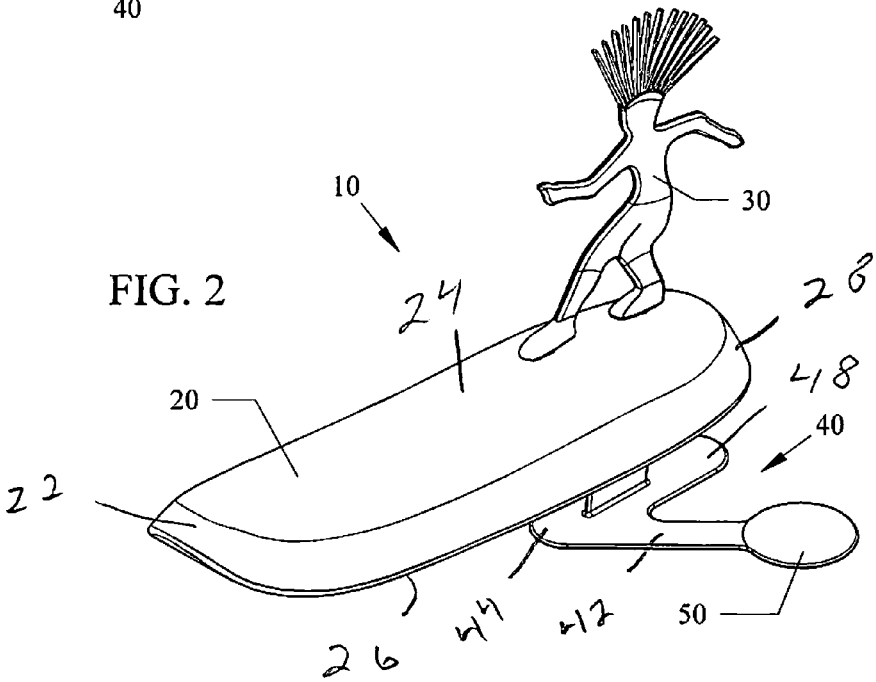
FIG. 2 is a top left perspective view of the surfboard toy of FIG. 1.
Figure 3:
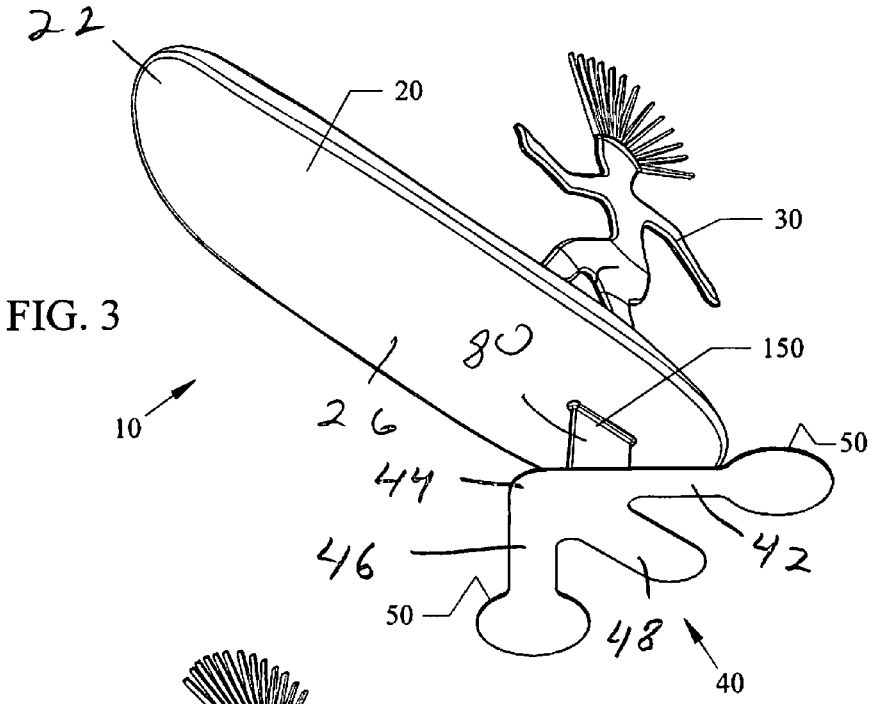
FIG. 3 is a bottom left perspective view of the surfboard toy of FIG. 1.
Figure 4:
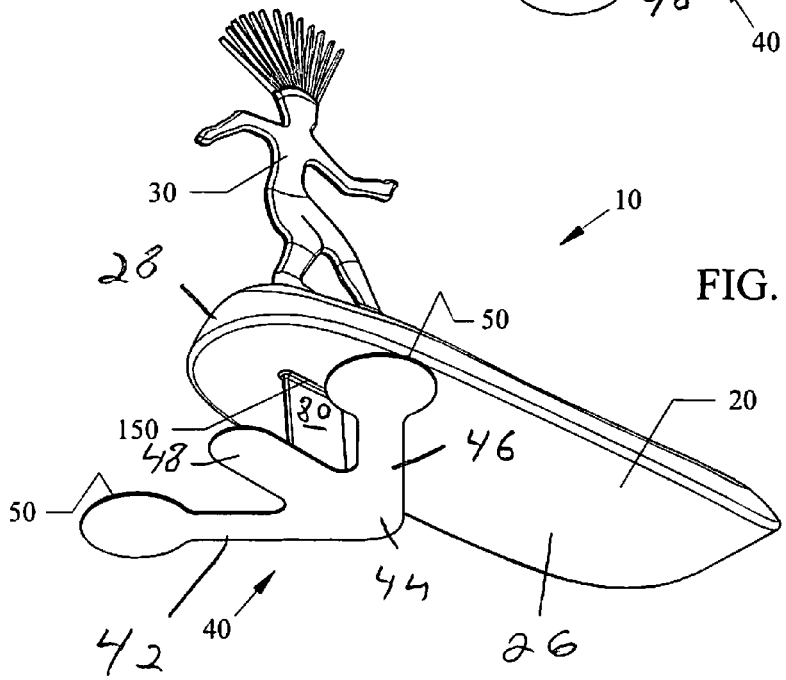
FIG. 4 is a bottom right perspective view of the surfboard toy of FIG. 1.

10 Surfboard toy.
20 Floatation board.
22 front upwardly curving end (nose)
24 top surface
26 bottom surface
28 rear end
30 Surfer figurine.
40 Hydrofoil-generally V or boomerang shape (weighted)
42 left wing/vane
44 apex
46 right wing/vane
48 stabilizing tail/rudder
50 wing end stabilizers/weights (curved portions or disc shapes).
60 figurine mounting pegs.
70 figurine mounting holes in floatation board.
80 Keel/strut member
82. mount tenon (male member).
90 Keel mount mortise in bottom of surfboard.
100 Shore surf.
110 Small breaking shore wave.
120 Person.
130 Water line.
140 Floatation zone of surfboard toy.
150 Pivot point around which Surfer Dude assembly rotates when acted upon by a breaking wave FIG. 1 is a top right perspective view of surfboard toy 10 having floatation board 20 with mounted figurine 30 and hydrofoil 40. FIG. 2 is a top left perspective view of the surfboard toy 10 of FIG. 1. FIG. 3 is a bottom left perspective view of the surfboard toy 10 of FIG. 1. FIG. 4 is a bottom right perspective view of the surfboard toy 10 of FIG. 1.

Figure 5:
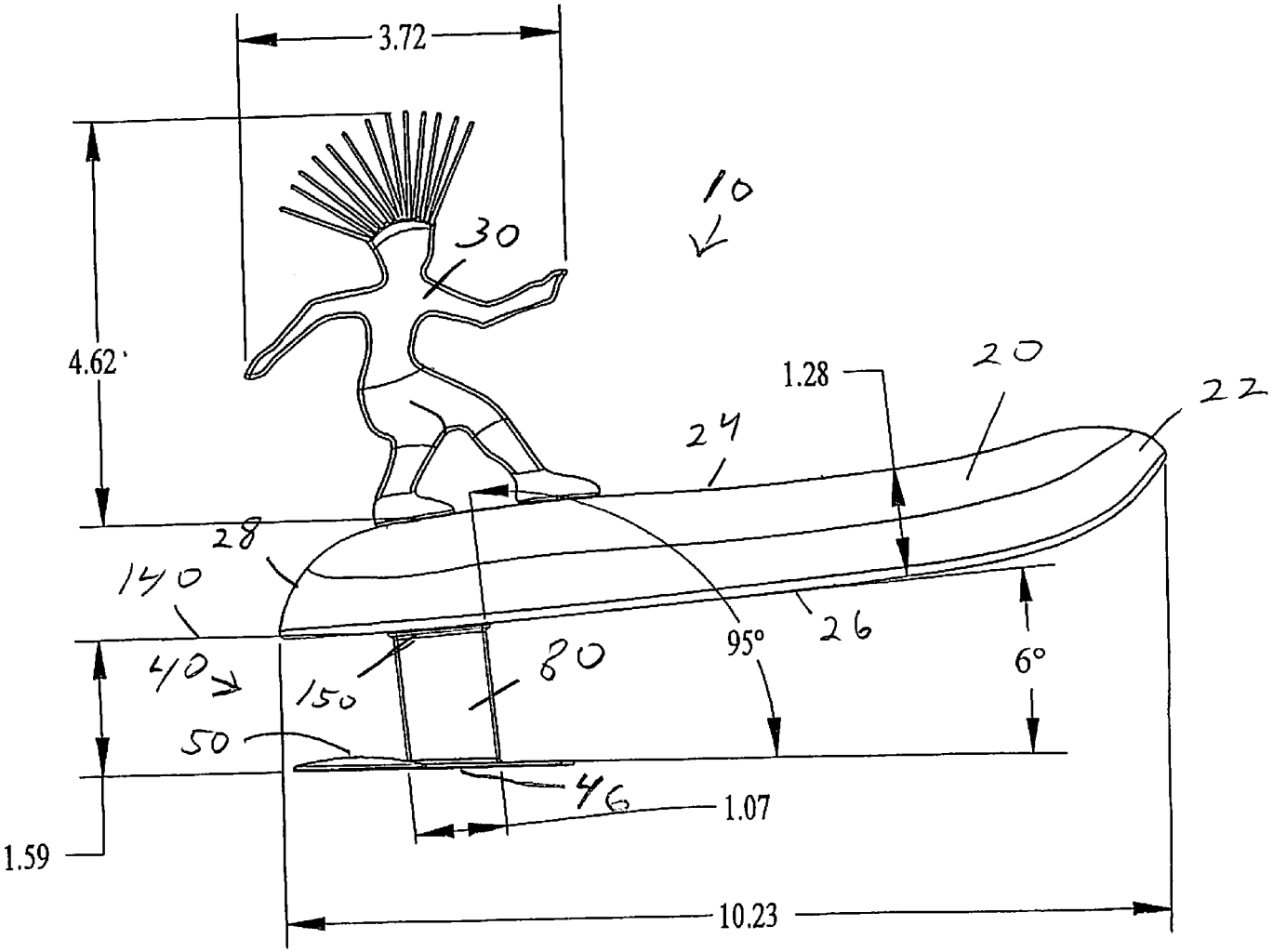
FIG. 5 is a side view of the surfboard toy of FIG. 1.
Figure 6:
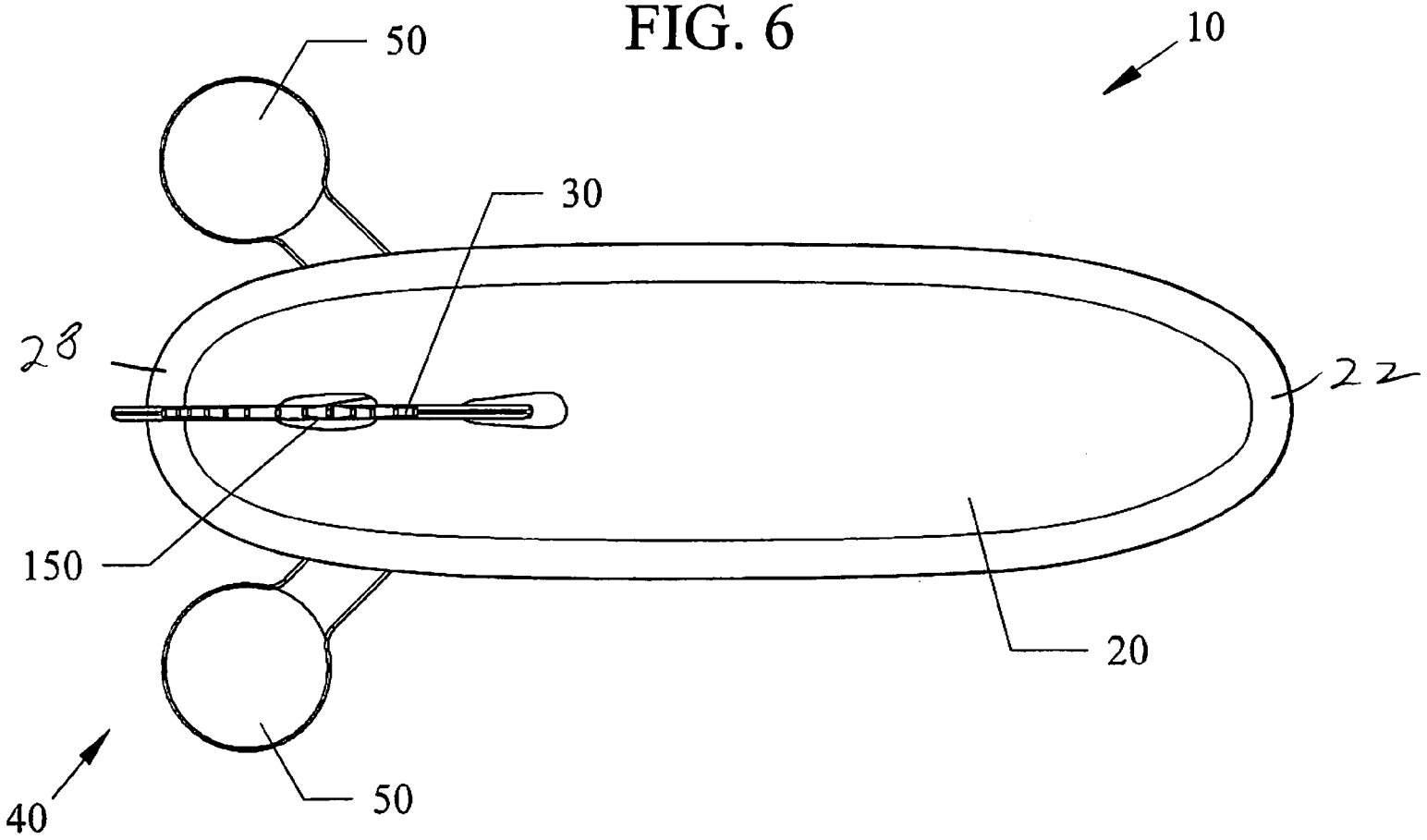
FIG. 6 is a top view of the surfboard toy of FIG. 1.
Figure 7:
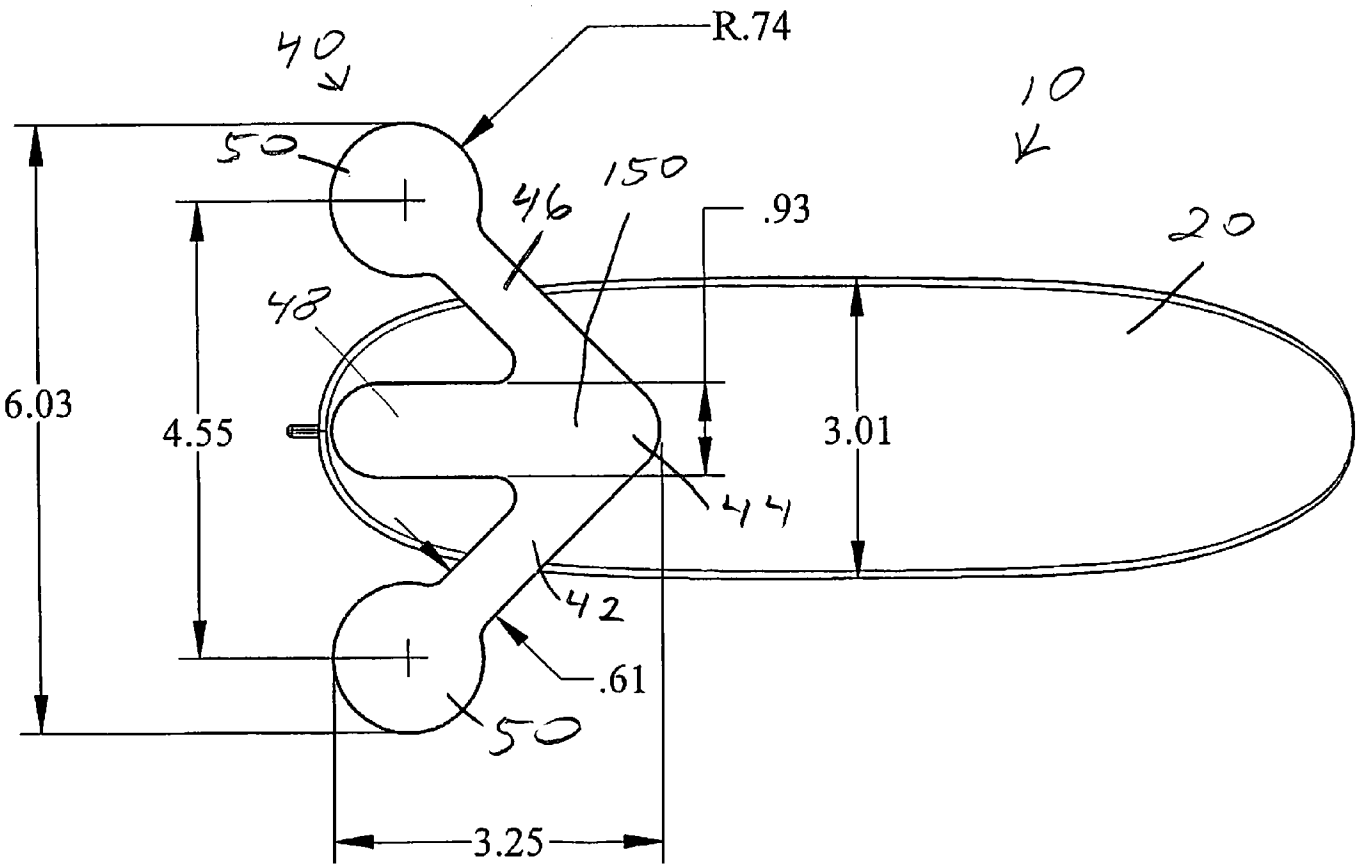
FIG. 7 is a bottom view of the surfboard toy of FIG. 1.
Figure 9:
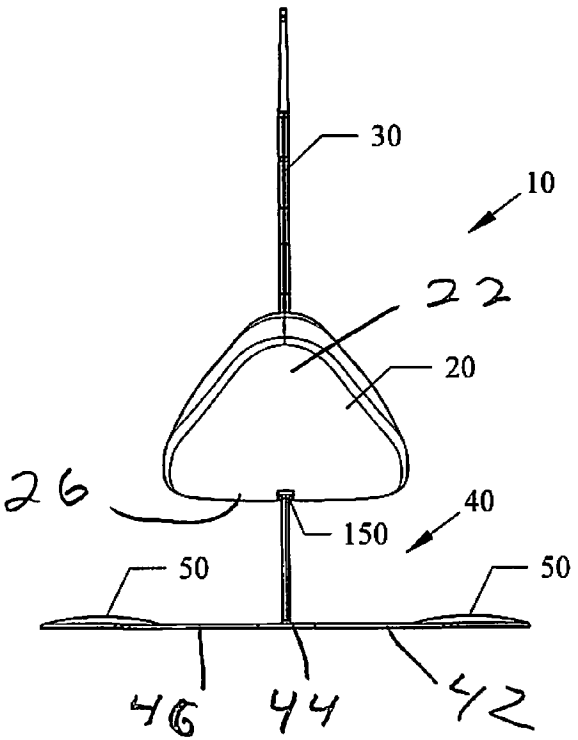
FIG. 9 is a front view of the surfboard toy of FIG. 1.
Figure 8:
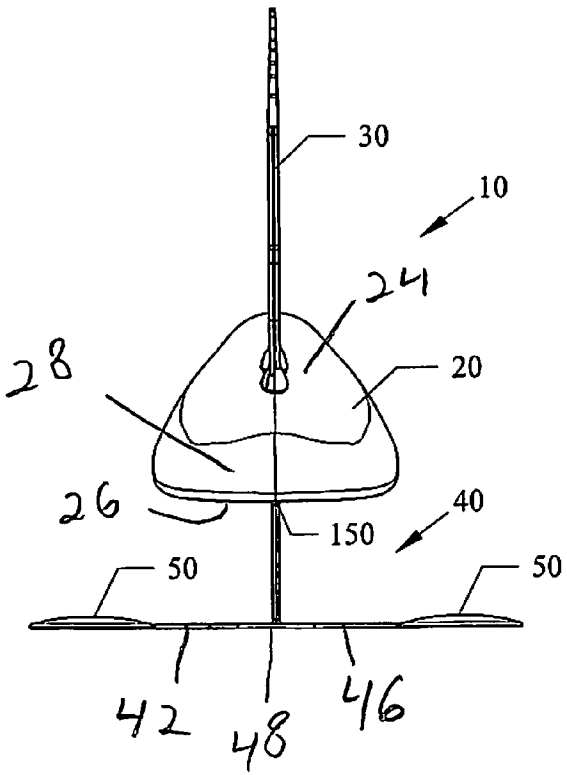
FIG. 8 is a view of the surfboard toy of FIG. 1.
Figure 11:
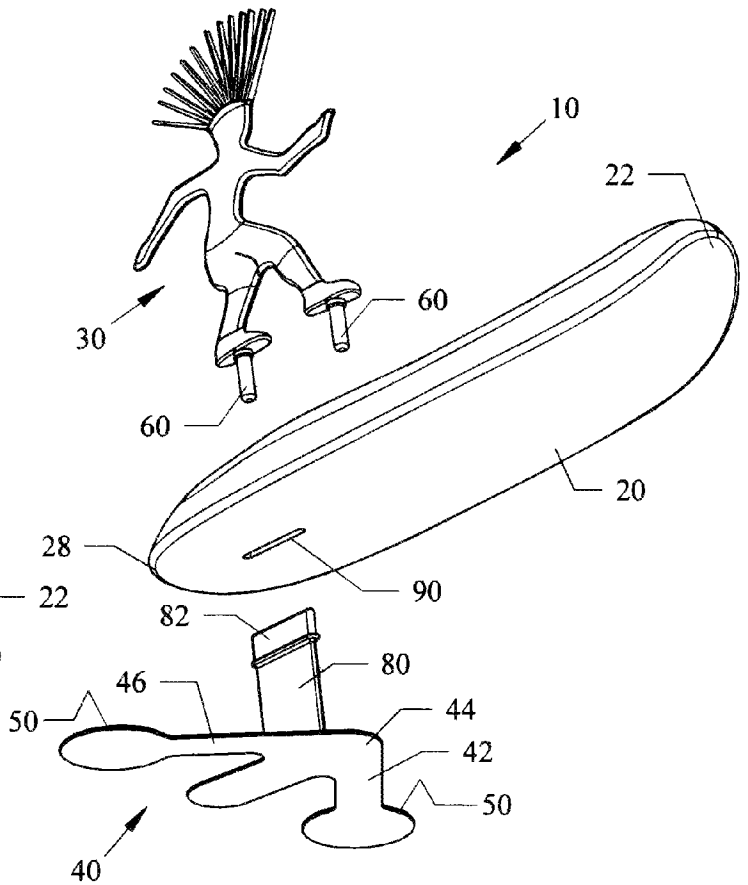
FIG. 11 is a bottom exploded perspective view of the surfboard toy of FIG. 1.
Figure 10:
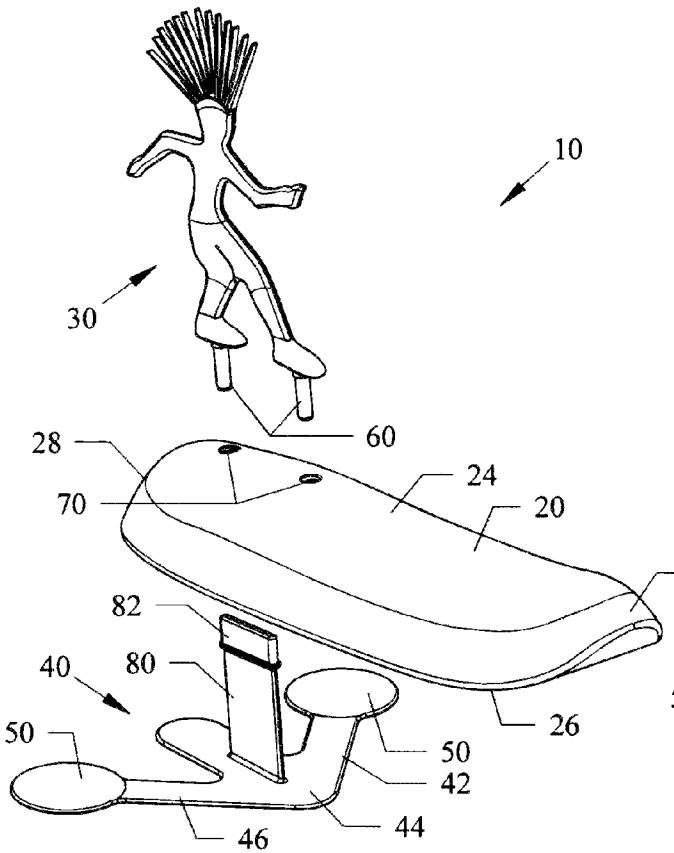
FIG. 10 is a top exploded perspective view of the surfboard toy of FIG. 1.

FIG. 5 is a side view of the surfboard toy 10 of FIG. 1 with dimensions of a preferred embodiment. FIG. 6 is a top view of the surfboard toy 10 of FIG. 1. FIG. 7 is a bottom view of the surfboard toy 10 of FIG. 1 with dimensions of a preferred embodiment. FIG. 8 is a view of the surfboard toy 10 of FIG. 1. FIG. 9 is a front view of the surfboard toy 10 of FIG. 1. FIG. 10 is a top exploded perspective view of the surfboard toy 10 of FIG. 1. FIG. 11 is a bottom exploded perspective view of the surfboard toy 10 of FIG. 1.

Surfboard 20

Referring to FIGS. 1-11, the novel surfboard toy 10 can include a floatation board 20 having a front upwardly curving end 22 with rounded tip and a rear end 28 with rounded edge with a top side 24 and bottom side 26. The floatation board 20 can be formed from injection molded foam, or foam rubber cut into a selected shape, or other lightweight material impervious to water. Alternatively, the board 20 can be formed from injection molded plastic hollow housing with rubber placed inside the plastic shell.

Referring to FIGS. 5-7, the surfboard 20 can have dimensions of approximately 10.23 inches in length from the front end 22 to the rear end 28, and have a width of approximately 3.01 inches that tapers down at both the front end 22 and the rear end 29 to rounded tips. The thickness of the surfboard 20 can have a thickness of approximately 1.28 inches with the rear end 29 curving downward to an outer edge. The surfboard 20 has a generally flat bottom surface 26 that curves upward near the front end 22 in order to aid in lift of the surfboard when riding incoming waves.

Figurine 30

Referring to FIGS. 1-11 and mounted to the top surface 24 of the surfboard 20 adjacent to the rear end 28 can be surfer figurine 30 mounted thereon. The figurine 30 can have downwardly extending male members 60, such as pegs, that are insertable into figurine mounting holes (female receptacles) 70 on the top surface 24 of the surfboard 20 adjacent to the rear end 28 of the surfboard 20 as shown in FIGS. 10-11. The pegs 60 can be locked into the mounting holes 70 with waterproof glue or cement and the like.

Referring to FIG. 5, the figurine 30 can be formed from injection molded plastic and the like, and have a height from a foot portion mounted to the top surface 24 of the surfboard 20 to the top of the head portion to be approximately 4.62 inches and a width of approximately 3.72 inches between ends of the outstretched hands. Additionally, the figurine 30 can be formed from a lightweight foam so that it will stay upright easily while being pummeled by waves as the toy 10 is being used in the surf of incoming waves. The figurine can be narrow thin stick figure turned sideways so the plane of the planar shaped body is in the same plane as the keel/strut member 80 mounted underneath the board 20. The figurine 30 can be mounted almost directly above the keel/strut member 80.

Hydrofoil 40 and Keel/Strut Member 80

Referring to FIGS. 1-11, and mounted underneath the surfboard 20 adjacent to the rear end 28 can be a hydrofoil 40. A generally rectangular and narrow diameter keel type strut member 80 can be turned so that one side edge faces forward and the opposite side edge faces rearward. The keel/strut member can have a upper male member (tenon) that fits into a mateable slit 90 on the bottom surface 26 of the surfboard 20 adjacent to the rear end 28 of the surfboard 20 can be locked with waterproof glue or cement and the like.

Referring to FIG. 5, the keel/strut member 80 can have a height of approximately 1.59 inches between the bottom surface 26 of the surfboard and the top of the generally flat left wing/vane (not shown) and right wing/vane 47 of the hydrofoil 40.

Referring to FIGS. 1-11, the hydrofoil 40 can have a generally V or boomerang shape with a generally flat thin left wing/vane 42 connected to a generally flat thin right wing/vane 46 by a rounded/curved tip apex portion 44. The outer free ends of the left wing/vane 42 and right wing/vane 46 extend rearward from the apex portion and outward from the sides of the surfboard 20, and end in additional stabilizer/weighted curved portions 50. The wing end stabilizer/weighted portions 50 can be curve shaped and can include disc shapes and the like. The wing end stabilizer/weighted portions 50 can be slightly thicker with a slightly rounded top surface to add additional stabilizing weight to the hydrofoil 40. Extending rearward from the apex portion 44 can be an optional generally flat stabilizing tail rudder 46 located between the left wing/vane 42 and the right wing/vane 46.

Referring to FIGS. 5 and 7, the hydrofoil 40 can have an overall length between outer ends of the of outer stabilizing weights to be approximately 6.03 inches, and a length from the apex portion outer edge 44 to the outer end of the tail/rudder member 48 to be approximately 3.25 inches. Each of the wings/vanes 42, 46 can have a width of approximately 0.61 inches, with a width of the tail/rudder member 48 being approximately 0.93 inches. Each of the wing end stabilizers/weights 50 can have a radius of approximately R.74, and the distance between center points of each wing end stabilizers/weights 50 from one another can be approximately 4.55 inches.

The angle between the wings/vanes 42, 46 of the generally V shape or generally boomerang shaped hydrofoil 40 can range between approximately 10 to approximately 120 degrees. A narrower range can be between approximately 22 to approximately 60 degrees, and a narrower range of a preferred embodiment can range between approximately 35 to approximately 5 degrees.

Both the keel/strut member 80 and the hydrofoil 40 can be formed from hardened plastic, that was injection molded, and can include metal layer imbedded within the plastic. The weight of the keel/strut 80 and hydrofoil 40 can be approximately 1.3 ounces, while the entire weight of the figurine 30, surfboard 20 and keel/strut member 80 with hydrofoil 40 can be approximately 2.2 ounces. As such, the weight of keel/strut member 80 and the hydrofoil 40 can easily counter-balance the lighter weight of the figurine 30 to counter balance the figurine 30 in order to keep the surfboard toy 10 in an upright floating position. The plane of the wings 42, 46 of the hydrofoil to the generally flat bottom surface 26 of the surfboard can be slightly angled so that the bottom surface 26 of the surfboard 20 angles upward toward the front end 22 approximately 6 degrees.

The figurine 30 can be mounted to be approximately perpendicular to the top surface 24 of the surfboard 20. The generally flat top surface 24 of the surfboard 20 can have an angle of approximately 95 degrees relative to the flat wings 42, 46 of the hydrofoil 40.

The dimensions referenced in a preferred embodiment shown and described in relation to FIGS. 5,7, 21 and 22 are approximate. The term "approximately" can be +/−10% of the dimension numbers referenced for the preferred embodiment. The dimensions come from a preferred embodiment that has been tested in the ocean by the inventor to an effective working embodiment.

While FIGS. 5, 7, 21 and 22 show a preferred embodiment dimensions, the invention can use alternative dimensions when the toy is scaled up or scaled down to different sizes such as small as approximately 3 inches long as desired by the user.

Method of Playing with the Surfboard Toy

Figure 12:
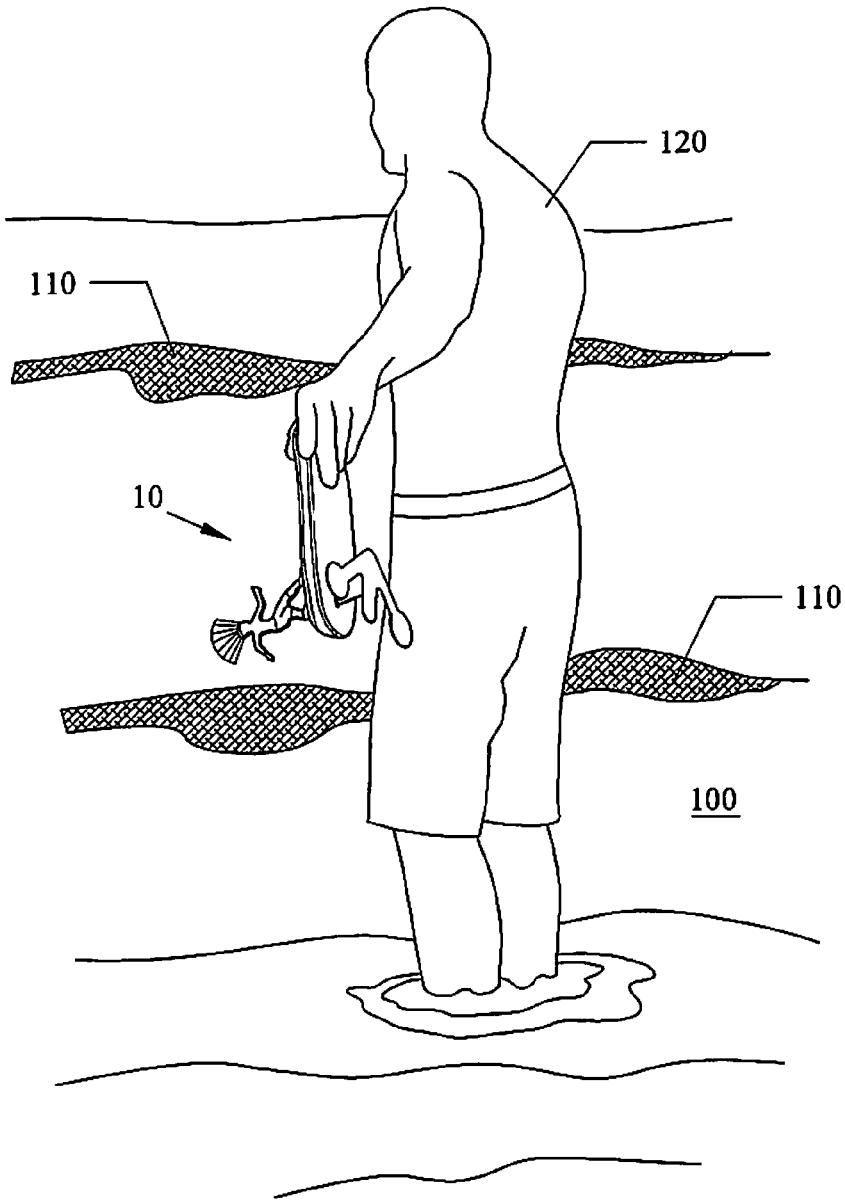
FIG. 12 shows a user on the back-swing of throwing a surfboard toy of FIG. 1 into the breaking surf from a shoreline.
Figure 13:
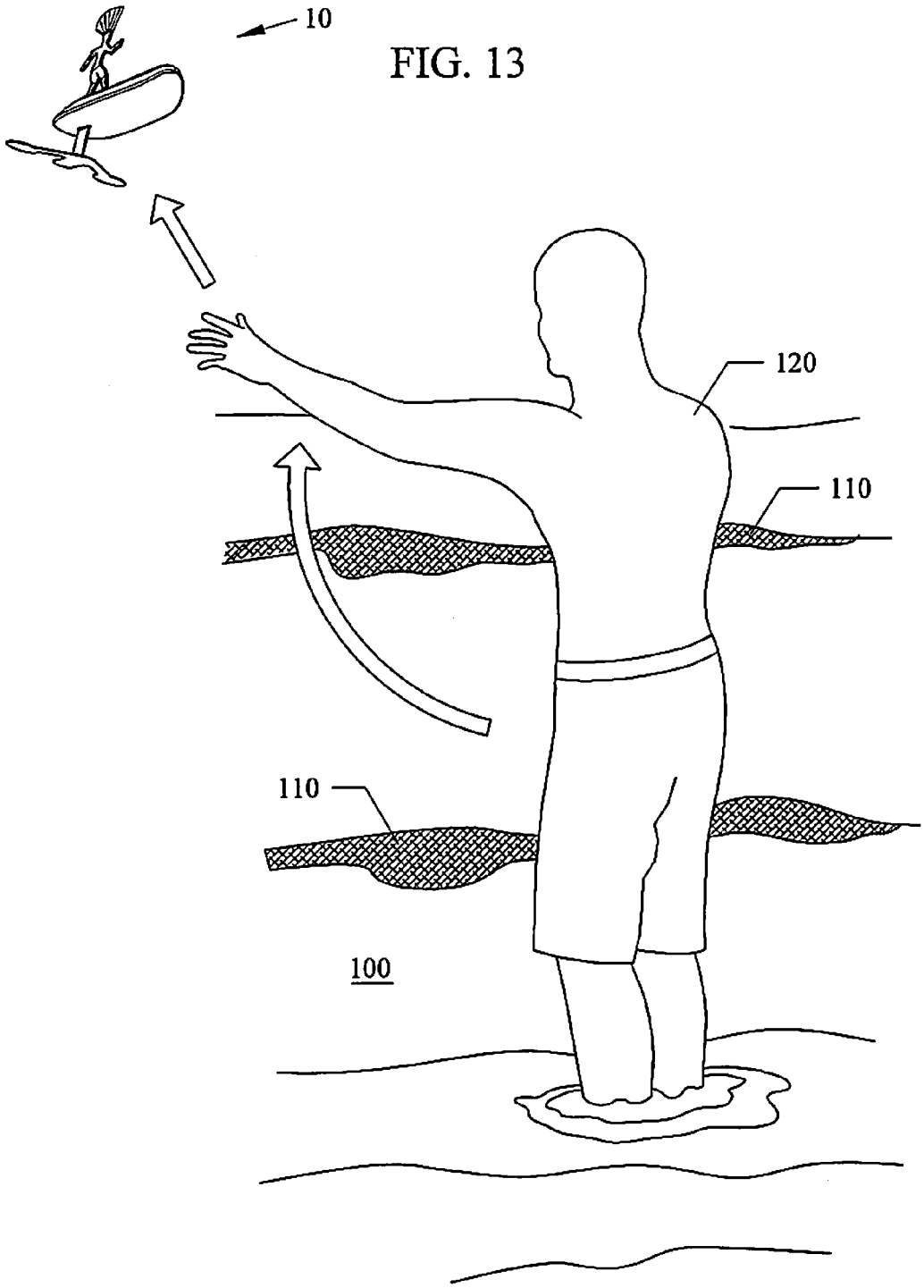
FIG. 13 shows the person in FIG. 12 throwing a toy into the breaking surf.

FIG. 12 shows a user 120 standing adjacent to a shoreline near the shore surf 100 and on the back-swing of throwing a surfboard toy 10 of FIG. 1 into the breaking surf 110. FIG. 13 shows the user 120 in FIG. 12 throwing the toy surfboard 10 into the breaking surf 110.

Figure 14:
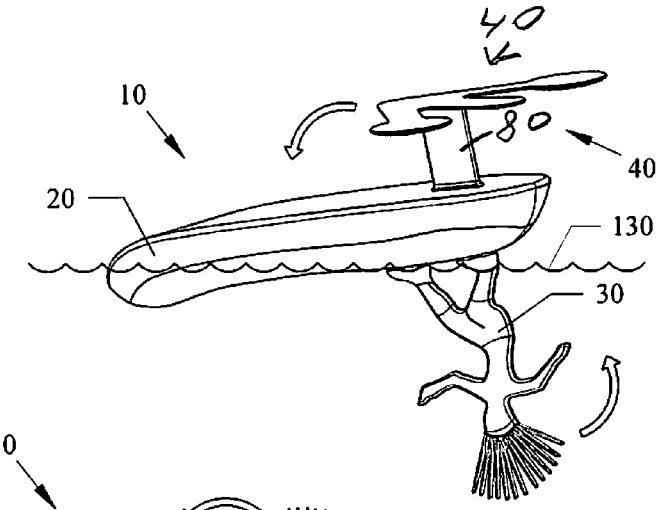
FIG. 14 shows the toy of FIG. 13 just after landing upside-down in the breaking surf.
Figure 15:
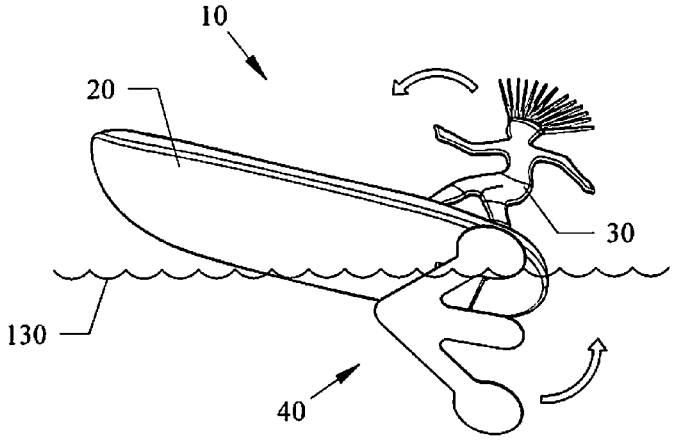
FIG. 15 shows the beginning the self righting ability of the toy in FIG. 14.
Figure 16:
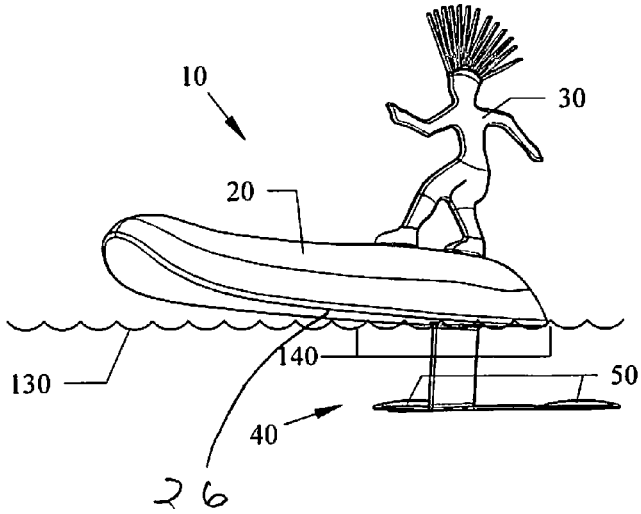
FIG. 16 shows the toy of FIG. 15 fully upright. Floatation zone in noted.

FIG. 14 shows the toy 10 of FIG. 13 just after landing upside-down in the breaking surf and resting on the water line 130. FIG. 15 shows the beginning the self righting ability of the toy 10 in FIG. 14. The weighted keel 80 and hydrofoil 40 will always insure that the surfboard toy 10 stays upright. FIG. 16 shows the toy 10 of FIG. 15 fully upright. Floatation zone in noted where a rear portion of the bottom surface 26 of the surfboard 20 can float on the water line 130 with the weighted hydrofoil 40 below the waterline 130.

Figure 17:
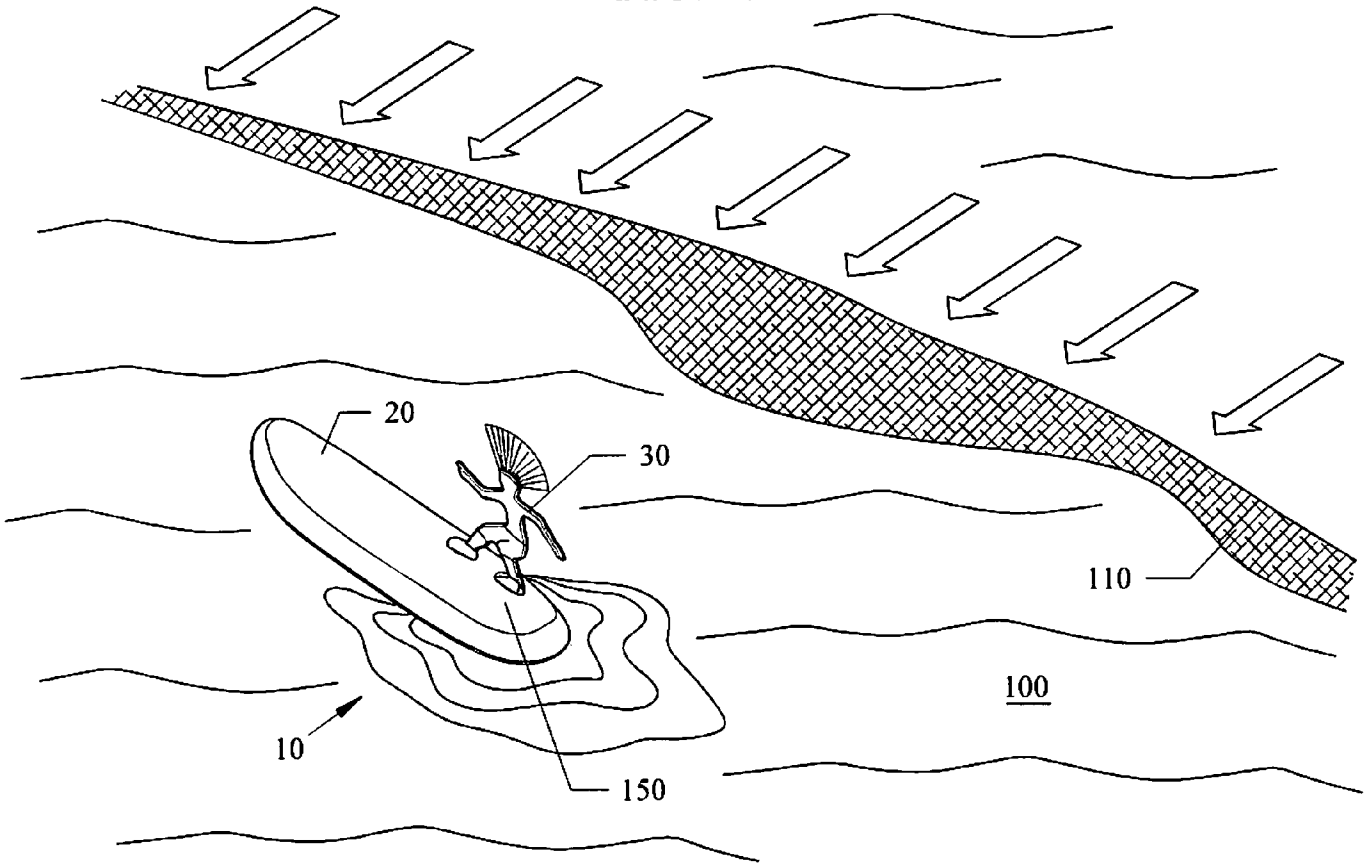
FIG. 17 shows the toy of FIG. 16 floating in the breaking surf with its side to the oncoming waves.

FIG. 17 shows the toy 10 of FIG. 16 floating in the breaking surf 100 with its side to the oncoming waves 110.

Figure 18:
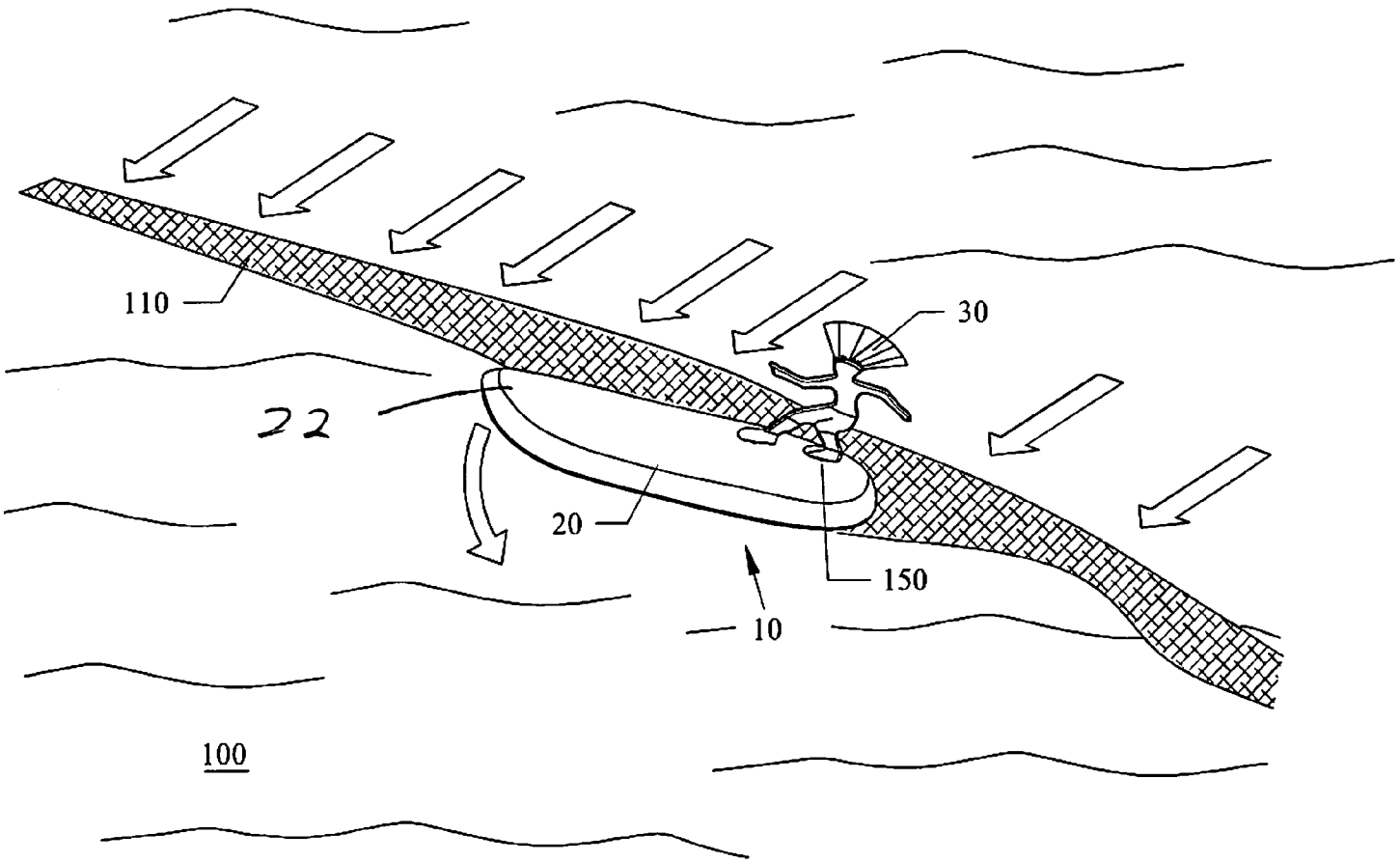
FIG. 18 shows the toy of FIG. 17 just being caught by a breaking wave. The front three quarters of the board float free of the water allowing the assembly to rotate about the floatation zone as the wave exerts its influence. This naturally points the nose of the floatation board in the direction of wave travel.
Figure 19:
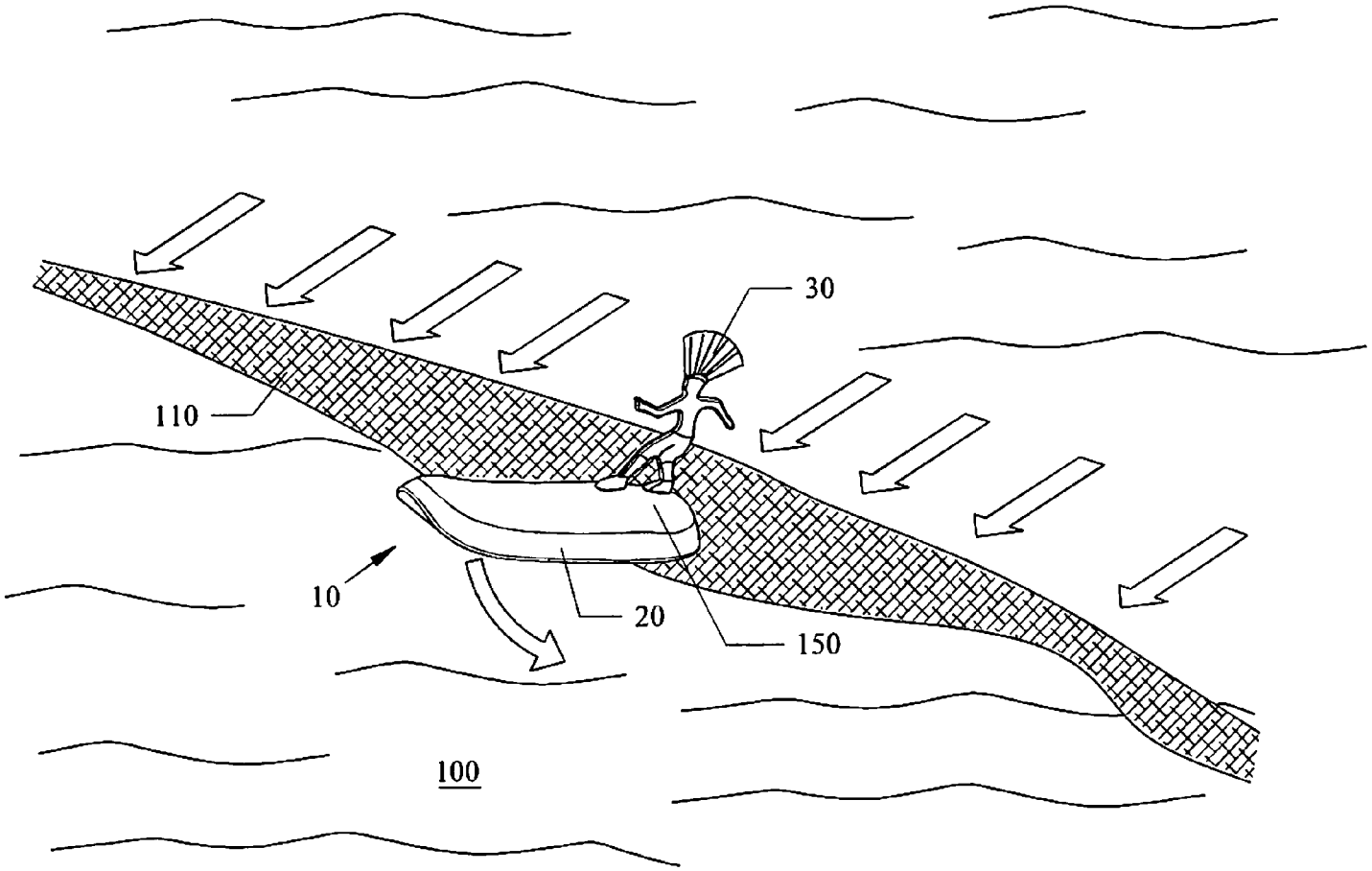
FIG. 19 shows the toy of FIG. 18 continuing to rotate influenced by the breaking wave.

FIG. 18 shows the toy 10 of FIG. 17 just being caught by a breaking wave 110. The front three quarters of the board 20 float free of the water allowing the toy 10 to rotate about the floatation zone 140 as the wave exerts its influence. This naturally points the nose (front end) 22 of the floatation board 20 in the direction of wave travel and pivots at a pivot point 15. FIG. 19 shows the toy 10 of FIG. 18 continuing to rotate influenced by the breaking wave 110.

Figure 20:
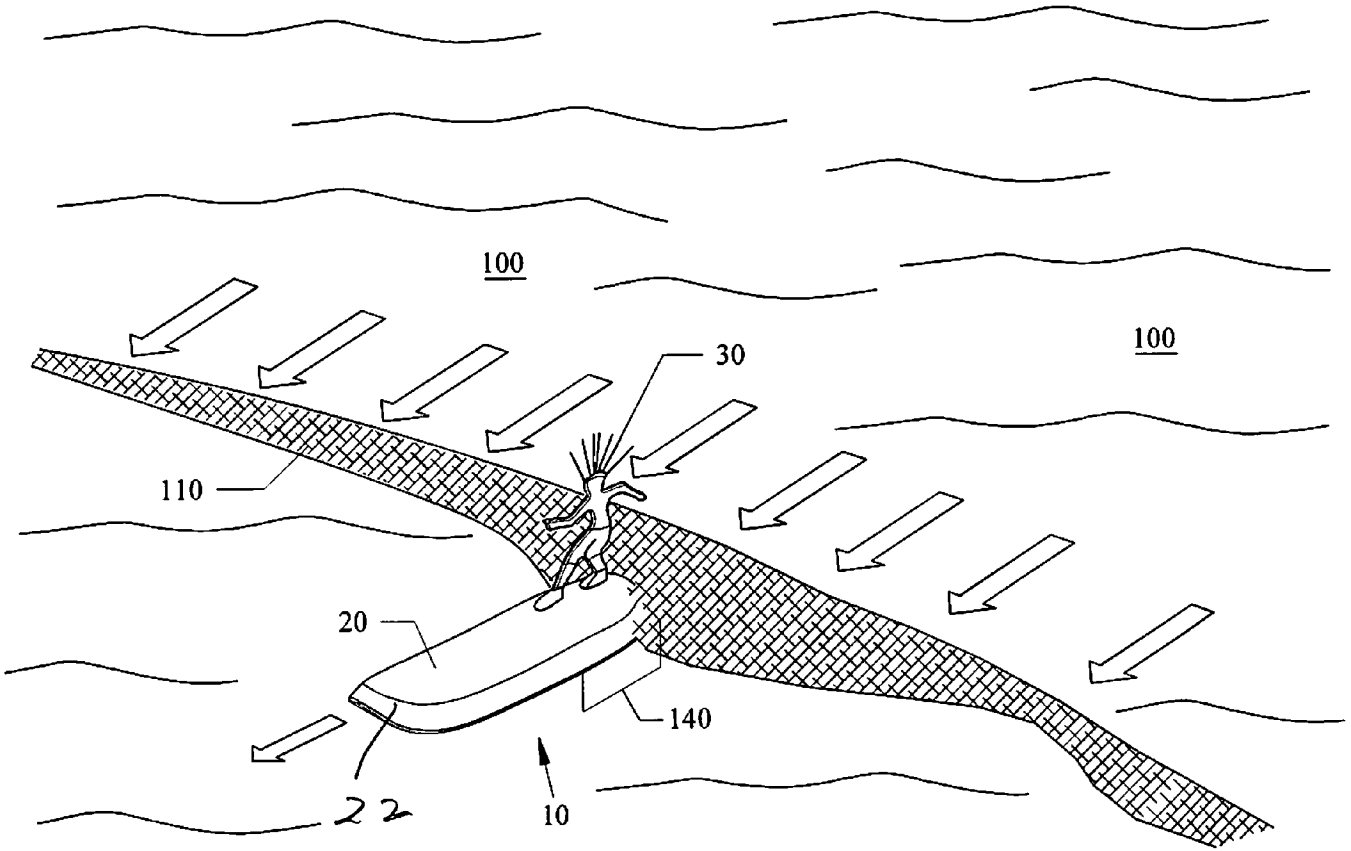
FIG. 20 shows the toy of FIG. 19 has full oriented itself with its nose in the direction of wave travel and is "surfing" on the breaking wave.

FIG. 20 shows the toy 10 of FIG. 19 has full oriented itself with its nose 22 in the direction of wave travel and is "surfing" on the breaking wave 110.

Figure 21:
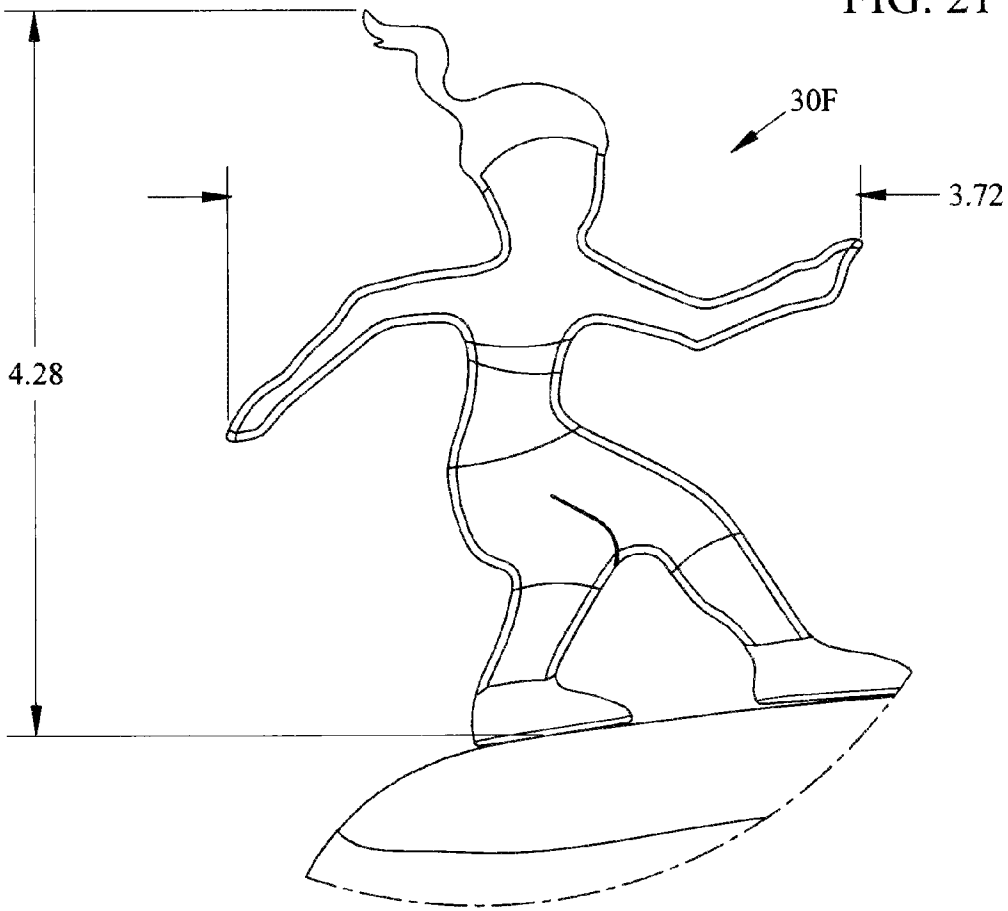
FIG. 21 is an enlarged view of an alternative figurine that can be mounted on the surfboard toy of FIG. 1.

FIG. 21 is an enlarged view of an alternative figurine 30F that can be mounted on the surfboard toy 10 of FIG. 1. The figurine 30F can have similar dimensions to the previously described figurine 30.

Additional games that can take place with the novel surfboard toys 10 can include two or more players tossing or throwing generally identical surfboard toys 10 into the surf and determining a winner when the first surfboard toy 10 reaches the shoreline.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A surfboard toy, comprising:

an elongated surfboard with front and rear ends, and top and bottom surfaces and left side edges and right side edges;

a figurine mounted to the top surface adjacent to the rear end of the surfboard, the figurine having a figurine weight; and a hydrofoil mounted attached to the bottom surface of the surfboard by a vertical strut member, the hydrofoil having a left leg member with a front portion and a free end, and a right leg member with a front portion and a free end, the front portion of the left leg member attached to the front portion of the right leg member to form a generally V shape or boomerang shape with an apex portion attached to a bottom end of the strut member, the free end of the left leg member extending rearwardly to the left from the front end of the surfboard, the free end of the right leg member extending rearwardly to the right from the front end of the surfboard, the free end of the left leg member having additional weight located away from and outside of the left side edges of the surfboard, the free end of the right leg member having additional weight located away from and outside of the right side edges of the surfboard, the hydrofoil having an overall hydrofoil weight, wherein the hydrofoil weight is greater than the figurine weight, wherein a majority of weight of the left leg member and a majority of weight of the right leg member are located away from and outside the left side edges and the right side edges of the surfboard.

2. The surfboard toy of claim 1, wherein the left leg member includes a left planar wing extending rearwardly to the left from the front end of the surfboard attached to a bottom end of the strut member, and the right leg member includes a right planar wing extending rearwardly to the right from the bottom end of the strut member.

3. The surfboard toy of claim 2, wherein the left planar wing and the right planar wing have a planar sheet configuration are in a horizontal plane so that the bottom surface of the surfboard is generally tilted upward.

4. The surfboard toy of claim 1, wherein the free ends of both the left leg member and the right leg member includes a curve portion being wider than a width of the free ends of both the left leg member and the right leg member.

5. The surfboard toy of claim 4, wherein the curve portion includes a cylindrical disc shape.

6. The surfboard toy of claim 1, wherein the hydrofoil includes:

a tail member extending rearwardly from the apex portion of the hydrofoil approximately midway between the left leg member and the right leg member.

7. The surfboard toy of claim 6, wherein the left leg member includes a left planar wing extending rearwardly to the left from the front end of the surfboard attached to a bottom end of the strut member, and the right leg member includes a right planar wing extending rearwardly to the right from the bottom end of the strut member, and the tail member includes a planar horizontal fin.

8. The surfboard toy of claim 7, wherein the left planar wing and the right planar wing and the tail planar fin are in a horizontal plane, and the bottom surface of the surfboard is slightly tilted upward relative to horizontal plane of the hydrofoil.

9. The surfboard toy of claim 8, wherein the free ends of both the left leg member and the right leg member includes a curve portion being wider than a width of the free ends of both the left leg member and the right leg member.

10. The surfboard toy of claim 9, wherein the curve portion includes a cylindrical disc shape.

11. The surfboard toy of claim 1, wherein the surfboard is formed from foam material.

12. The surfboard of claim 11, wherein the hydrofoil is formed from injection molded plastic with a metal insert therein and the figurine is formed from injection molded plastic.

13. A method of playing a game with a surfboard toy, comprising the steps of:

providing an elongated surfboard with front and rear ends, and top and bottom surfaces, and left side edges and right side edges;

mounting a figurine to the top surface adjacent to the rear end of the surfboard, the figurine having a figurine weight;

mounting a V or boomerang shaped hydrofoil to the bottom surface of the surfboard by a strut member extending downward from the bottom surface of the surfboard, the hydrofoil having a plane generally parallel to the bottom surface of the surfboard, the hydrofoil having a left leg with a front portion and a free end, and a right leg with a front portion and a free end, the front portion of the left leg being attached to the front portion of the right leg, with the free end of the left leg extending rearwardly from the front end of the surfboard, and the free end of the right leg extending rearwardly from the front end of the surfboard, the free end of the left leg member having additional weight located away from and outside of the left side edges of the surfboard, the free end of the right leg member having additional weight located away from and outside of the right side edges of the surfboard, the hydrofoil having an overall hydrofoil weight greater than the figurine weight, wherein a majority of weight of the left leg member and a majority of weight of the right leg member are located away from and outside the left side edges and the right side edges of the surfboard;

tossing the surfboard toy from a shoreline toward incoming waves;

causing the surfboard to turn upright with the figurine standing upward; and turning the surfboard to head back to the shoreline by the surfboard riding an incoming wave with the front end of the surfboard pointed in the direction of the shoreline.

14. The method of claim 13, wherein the step of providing the V or boomerang shaped hydrofoil includes the step of:

providing the hydrofoil with a left leg member and a right leg member attached to one another to form the V or boomerang shaped hydrofoil with an apex portion attached to a bottom end of the strut member, the left leg member extending rearwardly to the left out from the front end of the surfboard, and the right leg member extending rearwardly to the right out from the front end of the surfboard.

15. The method of claim 14, wherein the step of providing the V or boomerang shaped hydrofoil includes the step of:

providing a tail member extending rearwardly from the apex portion approximately midway the left and the right leg members.

16. The method of claim 15, wherein the step of providing the V or boomerang shaped hydrofoil includes the steps of:

providing the left leg member with a left planar wing extending rearwardly to the left from the front end of the surfboard attached to a bottom end of the strut member, and providing the right leg member with a right planar wing extending rearwardly to the right from the bottom end of the strut member, and the tail member includes a planar horizontal fin.

17. The method of claim 15, wherein the step of providing the V or boomerang shaped hydrofoil includes the step of:

providing the left planar wing and the right planar wing and the tail planar fin to be in a horizontal plane, and the bottom surface of the surfboard is generally tilted upward relative to the horizontal plane of the hydrofoil.

18. The method of claim 17, wherein the step of providing the V or boomerang shaped hydrofoil includes the step of:

providing the free ends of both the left leg member and the right leg member with a curve portion being wider than a width of the free ends of both the left leg member and the right leg member.

19. The method of claim 13, further comprising the steps of:

providing a second toy surfboard generally identical to the first toy surfboard; and racing the second toy surfboard against the first toy surfboard by having both the first and second toy surfboards being tossed out simultaneously to incoming waves from a shoreline; and determining a winner when one of the first and the second toy surfboards reaches the shoreline first.

* * * * *